US010800159B2

(12) United States Patent
Demange

(10) Patent No.: US 10,800,159 B2
(45) Date of Patent: Oct. 13, 2020

(54) MARKING MACHINE AND METHOD FOR IMPLEMENTING SUCH A MACHINE

(71) Applicant: Illinois Tool Works Inc., Glenview, IL (US)

(72) Inventor: Florent Demange, Montreal la Cluse (FR)

(73) Assignee: Illinois Tool Works Inc., Glenview, IL (US)

( * ) Notice: Subject to any disclaimer, the term of this patent is extended or adjusted under 35 U.S.C. 154(b) by 272 days.

(21) Appl. No.: 15/546,555

(22) PCT Filed: Jan. 26, 2016

(86) PCT No.: PCT/US2016/014912
§ 371 (c)(1),
(2) Date: Jul. 26, 2017

(87) PCT Pub. No.: WO2016/123097
PCT Pub. Date: Aug. 4, 2016

(65) Prior Publication Data

US 2018/0001615 A1 Jan. 4, 2018

(30) Foreign Application Priority Data

Jan. 27, 2015 (FR) ..... 15 50616

(51) Int. Cl.
*B41F 16/00* (2006.01)
*B41F 17/26* (2006.01)
(Continued)

(52) U.S. Cl.
CPC ..... *B41F 17/002* (2013.01); *B21D 22/022* (2013.01); *B41F 17/001* (2013.01);
(Continued)

(58) Field of Classification Search
CPC ..... B41F 16/0006; B41F 16/002; B41F 16/0026; B41F 16/004; B41F 16/0046;
(Continued)

(56) References Cited

U.S. PATENT DOCUMENTS 3,636,866 A * 1/1972 Stommel ..... B44B 5/0038 101/22
3,718,571 A 2/1973 Bidwell
(Continued)

FOREIGN PATENT DOCUMENTS

CA 2499715 A1 1/2003
DE 666432 C 10/1938
(Continued)

OTHER PUBLICATIONS

International Searching Authority, International Search Report for PCT Application No. PCT/US2016/014912, dated May 3, 2016, 2015, 68 pages.

*Primary Examiner* — Leslie J Evanisko
(74) *Attorney, Agent, or Firm* — The Small Patent Law Group LLC; Jason P. Gross

(57) ABSTRACT

A marking machine for marking an article and a method of operating the same. The marking machine has a marking head including a support and at least one punch. The marking machine also includes a positioning system configured to position the article with respect to the punch. The punch has rotational mobility about an axis of rotation that is fixed with respect to the support.

19 Claims, 10 Drawing Sheets

(51) Int. Cl.

| | |
|---|---|
| ***B21D 22/02*** | (2006.01) |
| ***B41F 17/00*** | (2006.01) |
| ***B41F 17/08*** | (2006.01) |
| ***B41F 17/28*** | (2006.01) |
| ***B41F 17/24*** | (2006.01) |
| ***B41F 17/18*** | (2006.01) |

(52) U.S. Cl.
CPC ..... *B41F 17/08* (2013.01); *B41F 17/18* (2013.01); *B41F 17/24* (2013.01); *B41F 17/28* (2013.01)

(58) Field of Classification Search
CPC ..... B41F 17/002; B41F 17/006; B41F 17/18; B41F 17/24; B41F 17/26; B41F 19/06; B41F 19/062; B41F 19/064; B41F 19/068; B21D 22/022
USPC ..... 101/4, 5, 9, 10, 11, 25, 27, 28, 31
See application file for complete search history.

(56) References Cited

U.S. PATENT DOCUMENTS

| | | | | | |
|---|---|---|---|---|---|
| 3,815,494 | A * | 6/1974 | Bahnmuller | B41F 19/062 | 101/23 |
| 4,207,998 | A | 6/1980 | Schmid | | |
| 4,351,234 | A * | 9/1982 | Keehner | B41F 17/24 | 101/10 |
| 5,147,495 | A * | 9/1992 | Douglas | B65C 9/1873 | 101/38.1 |
| 5,775,216 | A * | 7/1998 | Rouleau | B41F 19/068 | 101/10 |
| 8,245,550 | B2 * | 8/2012 | Willits | B26F 1/3806 | 101/22 |
| 2008/0216678 | A1 * | 9/2008 | Stockli | B44B 5/0076 | 101/25 |
| 2014/0216284 | A1 * | 8/2014 | Demange | B41F 16/0026 | 101/213 |

FOREIGN PATENT DOCUMENTS

| | | | |
|---|---|---|---|
| DE | 9420707 | A1 | 2/1995 |
| DE | 10009162 | A1 | 8/2001 |
| DE | 10163762 | A1 | 7/2003 |
| EP | 0623432 | A | 9/1994 |
| EP | 0858888 | A | 8/1998 |
| EP | 0989086 | A | 3/2000 |
| FR | 2913914 | A1 | 9/2008 |
| FR | 3001649 | A1 | 8/2014 |

* cited by examiner

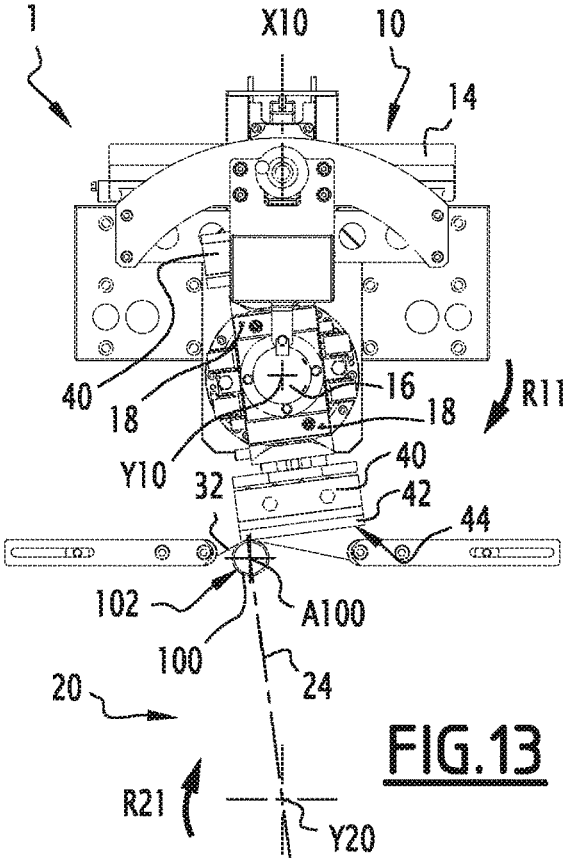
FIG.13
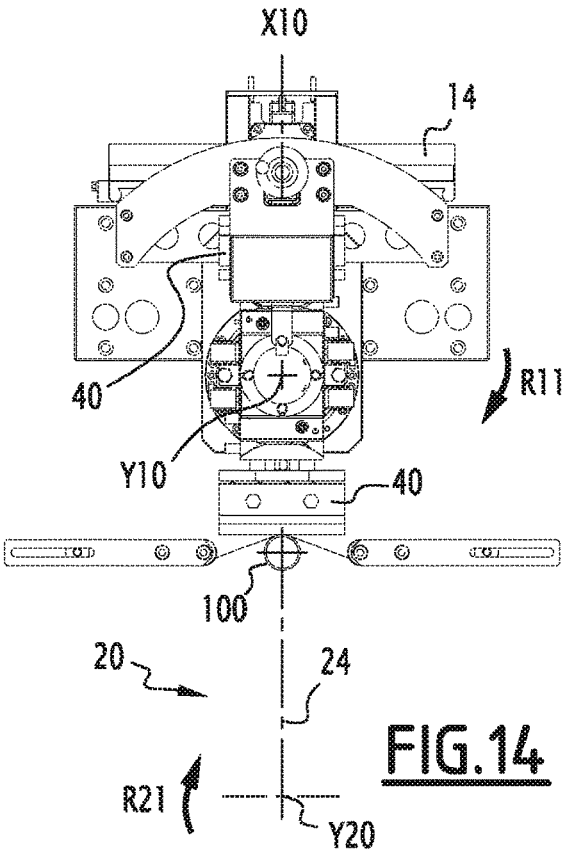
FIG.14
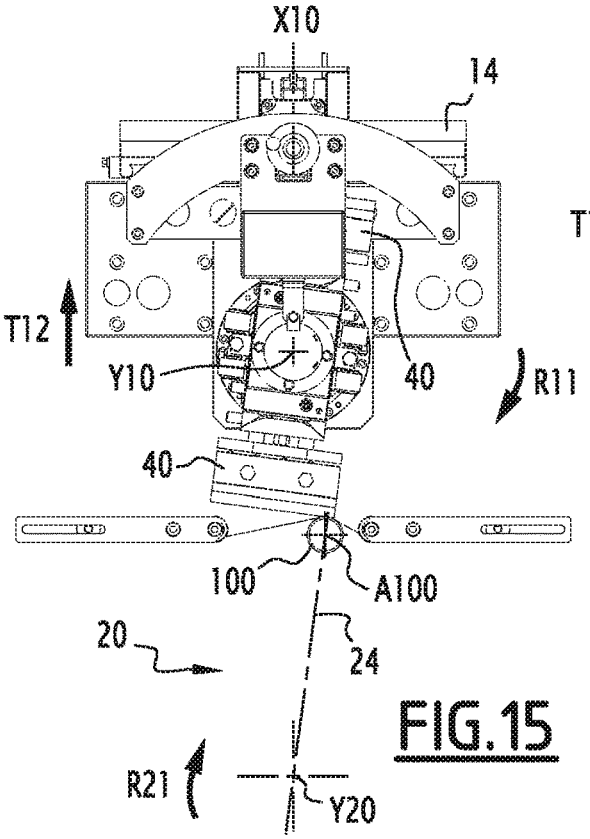
FIG.15
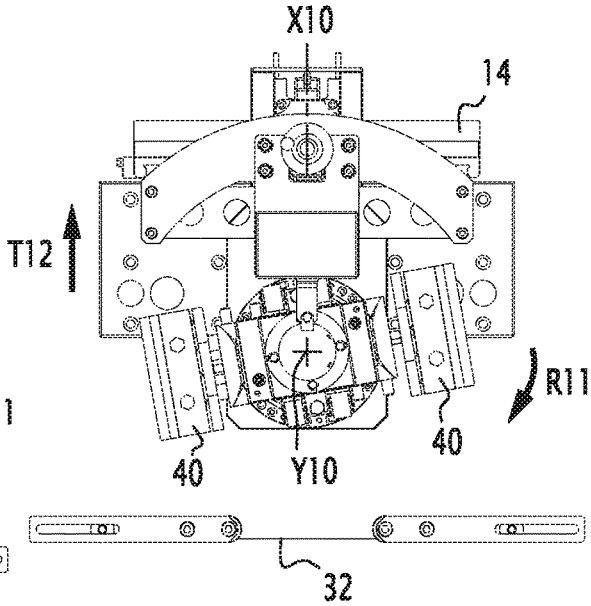
FIG.16
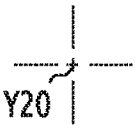

MARKING MACHINE AND METHOD FOR IMPLEMENTING SUCH A MACHINE

CROSS-REFERENCE TO RELATED APPLICATIONS

The present application is a national stage entry of PCT/US16/14912, filed on 26 Jan. 2016, which claims priority to French Application No. 1550616, filed on 27 Jan. 2015.

The present invention relates to a marking machine for marking, particularly hot-marking, articles. The invention also relates to a method of operating such a machine. The field of the invention is that of the marking of articles, such as containers, for example made of glass, of metal or of plastic.

BACKGROUND

In a way that is known, for example, from document FR-A-2 913 914, a marking machine comprises a marking head equipped with at least one marking member of the punch or roller type. The marking member is intended to apply a marking force to an article that is to be marked. The marking machine also comprises a system for positioning the article with respect to the marking head. The interposition of a marking tape between the marking head and the article allows a pattern to be created on the exterior surface of the article. As an alternative, the interposition of a label allows the exterior surface of the article to be marked by labeling.

According to a first embodiment, the marking member is a punch equipped with a flat pattern plate with translational mobility in several directions. The punch has translational mobility transversely for marking the article. The punch also has translational mobility upward, then transversely, then downward, so that it can be retracted and returned to its initial position between two marking cycles. The position of the marking surface of the flat pattern plate is easy to control. Furthermore, the flat pattern plate may advantageously be made of silicone, which is elastically deformable at the time of the marking of the article. However, the marking head is relatively bulky because of the amplitude of the movements it effects.

According to a second embodiment, the marking member is a roller with rotational and translation mobility for marking the article. The marking head equipped with a roller is more compact by comparison with a marking head equipped with a punch. However, the position of the cylindrical marking surface of the roller is more difficult to control. Furthermore, a cylindrical pattern plate is more expensive to produce.

It is an object of the present invention to propose a marking machine that overcomes the above disadvantages.

BRIEF SUMMARY

To this end, one subject of the invention is a marking machine for marking articles, this machine comprising: a marking head including a support and at least one punch fitted with a flat pattern plate; and a positioning system configured to position the article with respect to the punch. The marking machine is characterized in that the punch has rotational mobility about an axis of rotation that is fixed with respect to the support.

Thus, the invention offers a satisfactory compromise between, on the one hand, the smaller bulk of the marking head and, on the other hand, the precision with which the marking surface can be positioned. Rotation of the punch makes it possible to reduce the space required and the energy consumed by the movements of the marking head, by comparison with a punch able to move in a combination of vertical and transverse translational movements, or a combination of horizontal and transverse translational movements according to the configuration of the machine. In practice, the invention allows of the order of a 20 to 30% space saving in the transverse direction of the marking head. Furthermore, the indexing of the planar surface of the flat pattern plate is easy to control, by comparison with the cylindrical surface of a roller. By improving the relative positioning of the punch and the article, the invention makes it possible to compensate for defects and improve the quality of the marking. Furthermore, a flat pattern plate made of silicone is less expensive than a cylindrical pattern plate made of silicone.

According to other advantageous features of the marking machine according to the invention, considered in isolation or in combination:

The support is a carriage with translational mobility along a marking axis perpendicular to the axis of rotation such that the punch has translational mobility along the marking axis.

During a marking operation, the punch creates a mark by striking the article with translational mobility along the marking axis and without pivoting about the axis of rotation.

During a marking operation, the punch progressively marks the article with translational mobility along the marking axis and rotational mobility about the axis of rotation.

The punch has rotational mobility about the axis of rotation in an oscillatory movement.

The punch has rotational mobility about the axis of rotation in a one-way movement.

The positioning system comprises at least an arm for supporting the article with rotational mobility about a second axis of rotation parallel to the axis of rotation of the punch.

The positioning system comprises at least an arm for supporting the article with translational mobility with respect to the marking head.

The machine also comprises a system for distributing marking tape between the marking head and the article.

Another subject of the invention is a method for operating a marking machine as mentioned hereinabove. The method is characterized in that the punch has rotational mobility about the axis of rotation during at least part of a marking cycle including a marking operation.

According to other advantageous features of the method according to the invention, considered in isolation or in combination.

The punch also has translational mobility along a marking axis perpendicular to the axis of rotation during at least part of the marking cycle.

During the marking cycle: before the marking operation, the punch has rotational mobility about the axis of rotation; during the marking operation, the punch has translational mobility along the marking axis without pivoting about the axis of rotation, thus marking the article by striking it; and after the marking operation, the punch has rotational mobility about the axis of rotation.

During the marking operation, the punch has translational mobility along the marking axis and rotational mobility about the axis of rotation, thus progressively marking the article.

The punch has rotational mobility about the axis of rotation in an oscillatory movement.

The punch has rotational mobility about the axis of rotation in a one-way movement.

During the marking cycle, a support arm supporting the article and belonging to the positioning system has rotational mobility about a second axis of rotation parallel to the axis of rotation of the punch.

During the marking cycle, a support arm supporting the article and belonging to the positioning system has translational mobility with respect to the marking head.

BRIEF DESCRIPTION OF DRAWINGS

The invention will be better understood from reading the following description, given solely by way of nonlimiting example, and made with reference to the attached drawings in which:

FIGS. 13 to 16 are views analogous to FIGS. 6 to 9, showing a fourth embodiment of a marking machine according to the invention;

DETAILED DESCRIPTION

Figure 1:
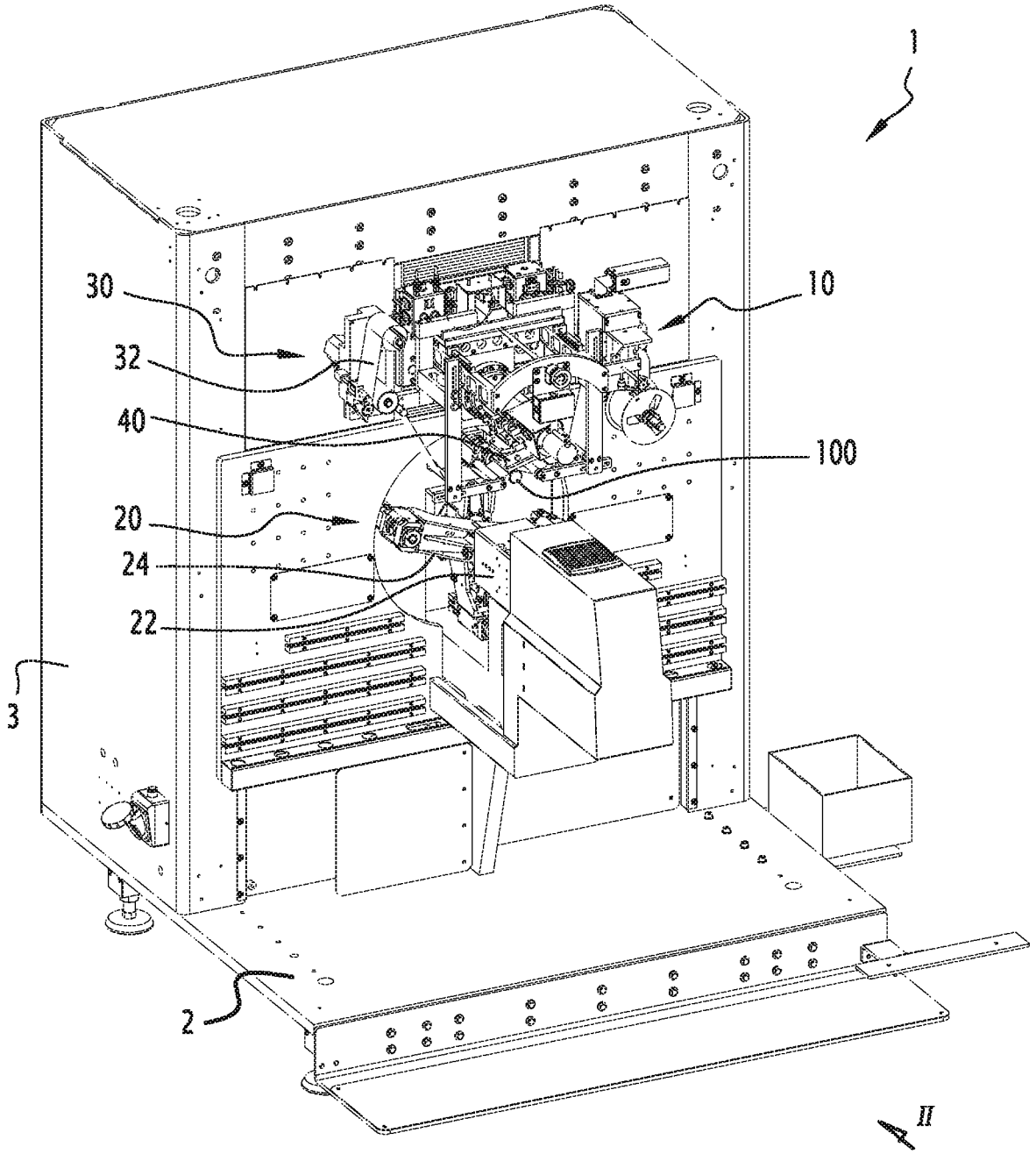
FIG. 1 is a perspective view of a marking machine according to the invention.

FIGS. 1 to 5 depict a marking machine 1 according to the invention.

The machine 1 is designed to decorate articles 100 by applying marks to the external surface thereof. In particular, the machine 1 is designed to hot mark plastic containers 100 of tubular, cylindrical or conical shape. Each container 100 comprises an external surface 102 that is to be marked, centered overall on a central axis A100. As an alternative, the machine 1 may be designed to mark other types of container 100, as detailed hereinafter.

The machine 1 comprises a base 2 for anchoring to the ground and a framework 3, which is fixed to the base 2 and forms a rigid structure. The machine 1 also comprises a control station, which for the sake of simplicity has not been depicted. The machine 1 also comprises a marking head 10, a system 20 for transporting containers 100 and positioning same facing the marking head 10, and a system 30 for distributing marking tape 32.

The marking head 10 comprises a frame 12, a carriage 14, a rotary unit 16, an arm 18 and a punch 40. In the case of a hot-marking machine 1, the punch 40 is equipped with heating means, for example heating cartridges built into the body of the punch 40. The frame 12 is fixed to the framework 3. The carriage 14 has translational mobility with respect to the frame 12 along a fixed vertical marking axis X10.

The rotary unit 16 is supported by the carriage 14. The rotary unit 16 has rotational mobility about a horizontal axis Y10 perpendicular to the axis X10. The axis Y10 is fixed with respect to the carriage 14 and therefore able to move with respect to the frame 12 and the axis X10. The rotary unit 16 supports the arm 18 which extends along an axis A10 perpendicular to the axis Y10 and has rotational mobility about this axis Y10. The arm 18 supports the punch 40 at its opposite end to the rotary unit 16. In other words, the elements 16 and 18 form means of causing the punch 40 to rotate about the axis Y10. The punch 40 comprises a flat pattern plate 42 made of silicone, provided with a planar marking surface 44. During an operation of marking a container 100, the marking head 10 is configured to apply a series of marking forces F40 to the container 100 under the action of the punch 40, as detailed hereinafter.

In practice, the elements 14, 16, 18 and 40 have translational mobility with respect to the frame 12 along the axis X10, selectively in a direction of translational movement T11 directed toward the positioning system 20 or in a direction of translational movement T12 opposite the direction of translational movement T11. For preference, the elements 16, 18 and 40 have rotational mobility about the axis Y10 in just one direction of rotation R11. In the example of FIGS. 2 to 5, the direction R11 corresponds to the clockwise direction, when standing facing the machine 1. As an alternative, the elements 16, 18 and 40 may have rotational mobility about the axis Y10 selectively in a clockwise direction of rotation R11 or in a counterclockwise direction of rotation R12, as detailed hereinafter.

The positioning system 20 comprises a fixed unit 22 secured to the framework 3. The fixed unit 22 supports several arms 24 having rotational mobility about a fixed horizontal axis Y20 perpendicular to the axis X10 and parallel to the axis Y10. The positioning system 20 comprises four arms 24 in the example of FIGS. 1 to 5, with just three arms 24 being visible in FIGS. 1 and 2. In practice, the positioning system 20 comprises at least one arm 24. For preference, the arms 24 have rotational mobility about the axis Y20 with respect to the fixed unit 22 in just one direction of rotation R21.

Each arm 24 supports a holding device 26 at its opposite end to the fixed unit 22. Each holding device 26 is intended to accept a container 100 during a marking cycle, from the loading to the unloading thereof, with an intermediate marking operation performed by the punch 40 and the marking head 10. Each holding device 26 is intended to position the container 100 and the surface 102 thereof that is to be marked with respect to the marking head 10, in particular with respect to the marking surface 44 of the punch 40. For that reason, the axis A100 of the container 100 is kept substantially parallel to the axes Y10 and Y20.

Figure 2:
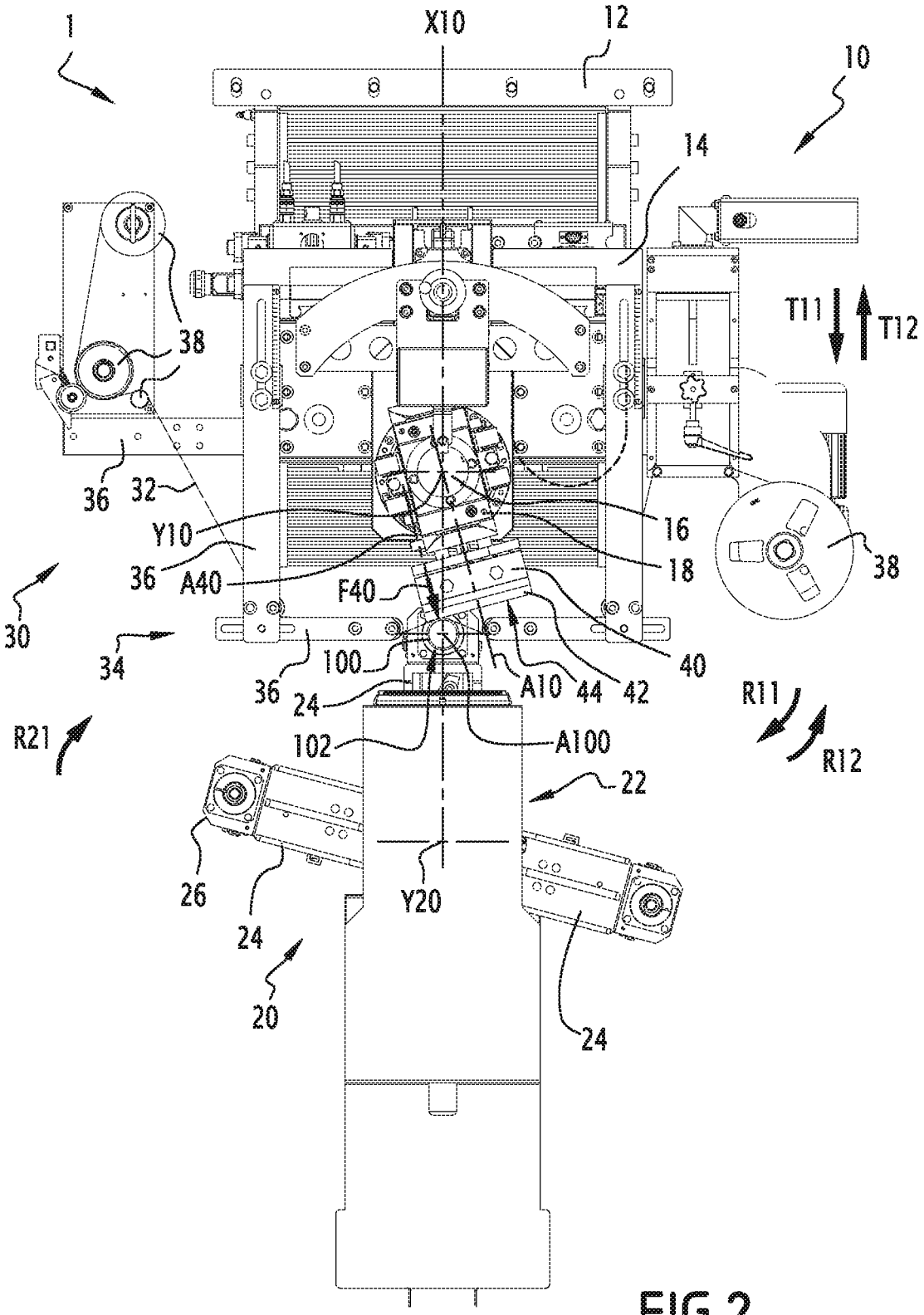
FIG. 2 is a partial front view of the marking machine in the direction of arrow II of FIG. 1.

In practice, the four arms 24 of the positioning system 20 may support up to three containers 100 simultaneously: one container 100 engaged before marking, one container 100 in the process of being marked, and one marked container 100 in the process of being unloaded. The arm 24 not visible behind the unit 22 in FIG. 2 is not supporting a container 100.

The distribution system 30 comprises a support structure 34 formed by structural elements 36 fixed to the carriage 14 of the marking head 10. In other words, the distribution system 30 is secured to the carriage 14 of the marking head 10 in terms of translational movement along the axis X10. The structural elements 36 support spools and rollers 38 of various sizes for paying out and guiding the tape 32. In particular, the distribution system 30 is configured to pay out a length of tape 32 between the marking head 10 and the container 100 supported by the positioning system 20 so that a pattern can be created on the exterior surface 102 of the container 100 during a marking operation.

Figure 3:
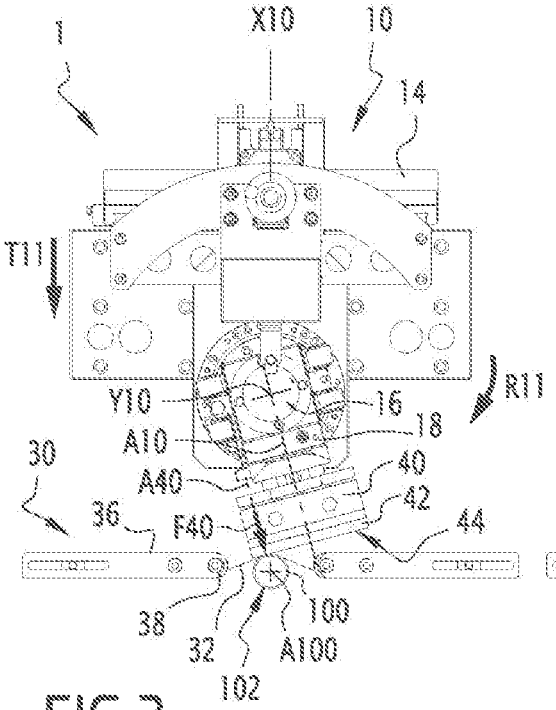
FIGS. 3 to 5 are other partial front views of the marking machine in a plane analogous to FIG. 2 and on a smaller scale, showing only an article and part of the marking head during various steps in an operation of marking this article.
Figure 4:
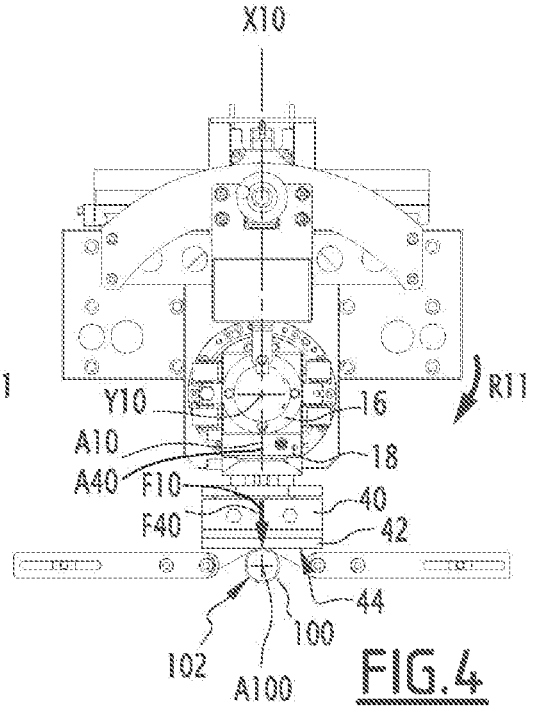
Figure 5:
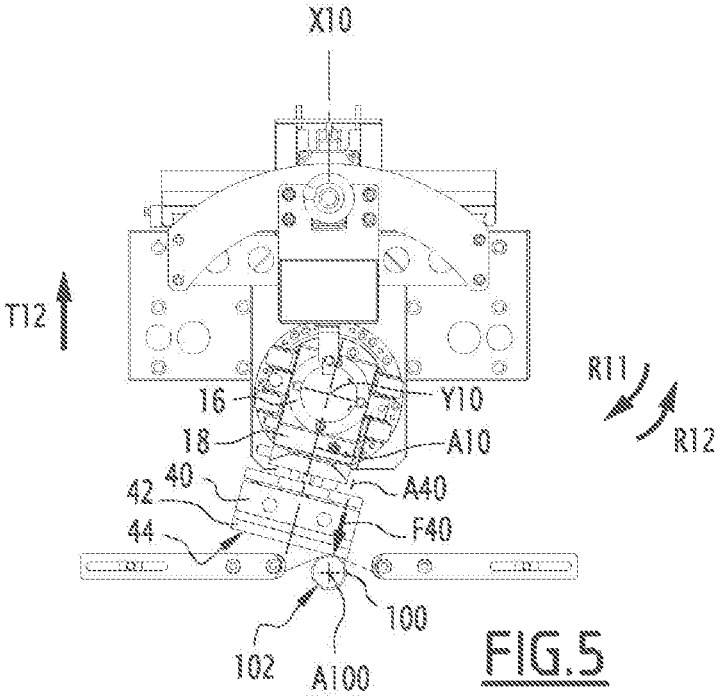
Figure 6:
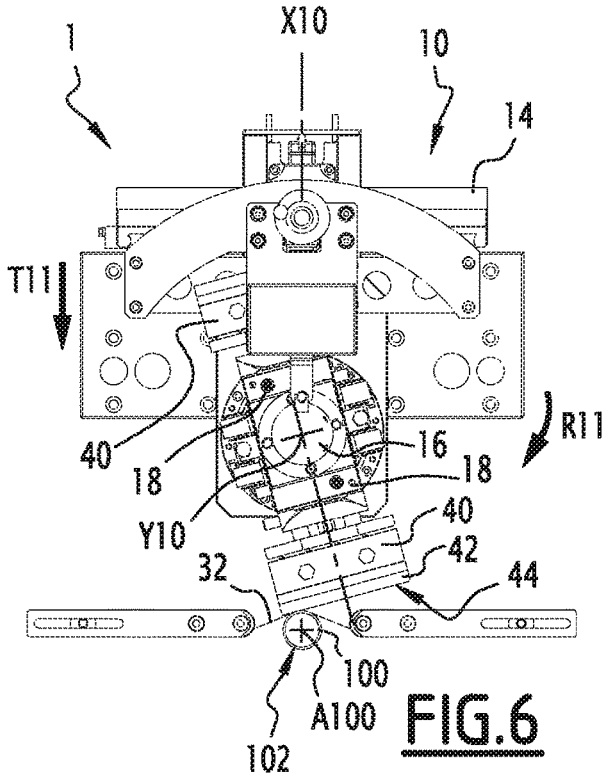
FIGS. 6 to 9 are views analogous to FIGS. 3 to 5, showing a second embodiment of a marking machine according to the invention.
Figure 7:
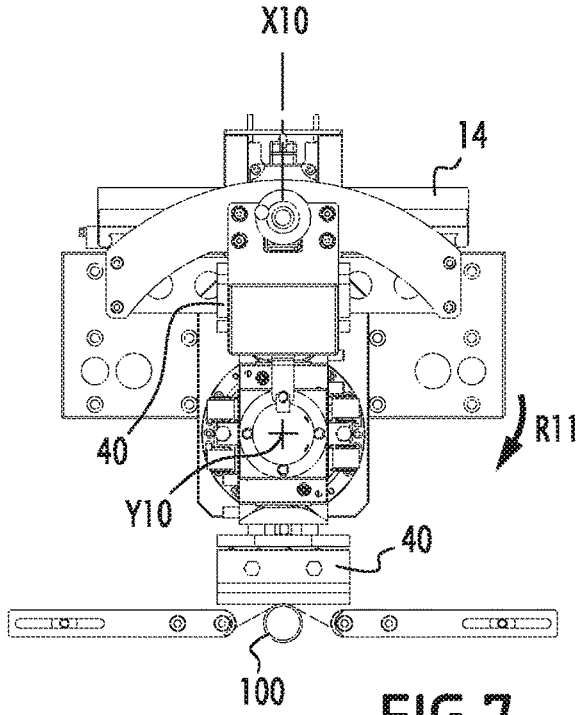
Figure 8:
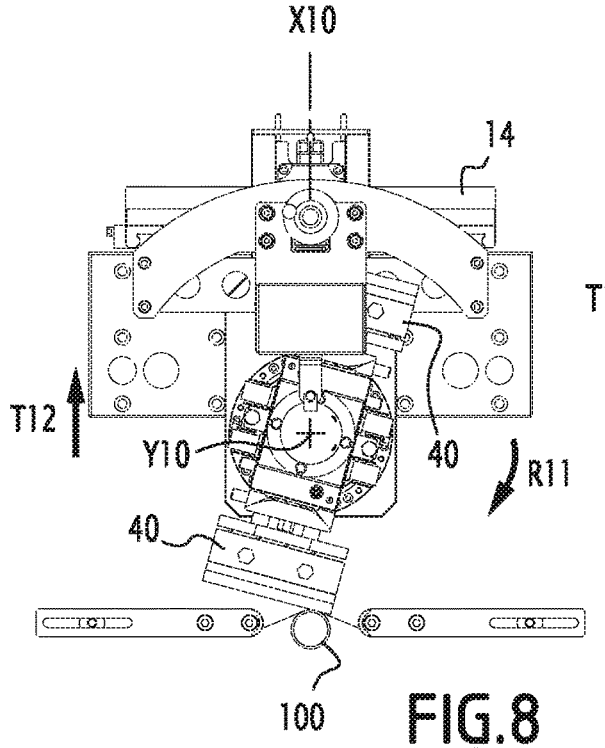

FIGS. 3 to 5 show various steps in a marking cycle, more specifically a marking operation, that involves marking the container 100 by action of the punch 40.

At the start of the marking cycle, the positioning system 20 positions the container 100 fixedly facing the marking head 10. The axis A100 of the container 100 is aligned with the axes Y10 and Y20. The elements 16, 18 and 40 have rotational mobility in the direction R11 about the axis Y10 until, at the start of the marking operation, the marking surface 44 of the punch 40 comes into contact with the surface 102 that is to be marked of the container 100.

During the marking operation illustrated in FIGS. 3 to 5, the punch 40 continues to rotate in the direction R11 about the axis Y10. At the same time, the carriage 14 and therefore the punch 40 have translational mobility along the axis X10, in the direction T11 then in the direction T12, in a back and forth reciprocating movement. The translational movement of the punch 40 is in the direction T11 in FIG. 3, then stops and is reversed in FIG. 4, and is then in the direction T12 in FIG. 5. The rotational and translational movements of the punch 40 are synchronized. Thus, the surface 44 of the flat pattern plate 42 presses against the surface 102 of the container 100, with the tape 32 interposed between them.

The marking of the surface 102 of the container 100 by the punch 40 is gradual. The container 100 is fixed whereas the punch 40 is able to move. At each moment during the marking operation, the surface 44 of the flat pattern plate 42 applies a constant marking force F40 to the container 100. This marking force F40 is directed along an axis of pressing A40 which is able to move in the plane of the figures while at the same time remaining parallel to the axis A10 and perpendicular to the axis A100. In FIG. 3, the axis A40 is situated on the left-hand side of the axis A10. In FIG. 4, the axes X10, A10 and A40 are aligned. In FIG. 5, the axis A40 is situated on the right-hand side of the axis A10. Thus, during the marking operation, the flat pattern plate 42 applies a resultant force F10 to the container along the axis X10. The force F10 is the resultant of the set of forces F40.

After the marking operation, the punch 40 continues to rotate in the direction R11 about the axis Y10 until the end of the marking cycle. Likewise, the carriage 14 may continue its translational movement in the direction T12 to move the punch 40 clear of the positioning system 20. This moving-clear operation is of small amplitude thanks to the ability of the punch 40 to rotate.

According to a first embodiment, the punch 40 makes a complete revolution in the direction R11 about the axis Y10, in order to mark the next container 100 during the next marking cycle. In other words, the punch 40 has rotational mobility in a one-way movement.

According to a second embodiment, the punch 40 performs an about-turn at the end of the marking cycle, then has rotational mobility in the direction R12 about the axis Y10, so as to mark the next container 100 during the next marking cycle, then once again in the direction R11 during the next cycle, and so on. In other words, the punch has rotational mobility in an oscillatory or reciprocating movement, namely one that alternates in the directions R11 and R12.

Other embodiments of a marking machine 1 according to the invention are shown in FIGS. 6 to 30. Certain constituent parts of the machine 1 are comparable with those of the first embodiment described hereinabove and, for the sake of simplicity, bear the same reference numerals. Only differences in comparison with the first embodiment are detailed hereinafter.

Figure 9:
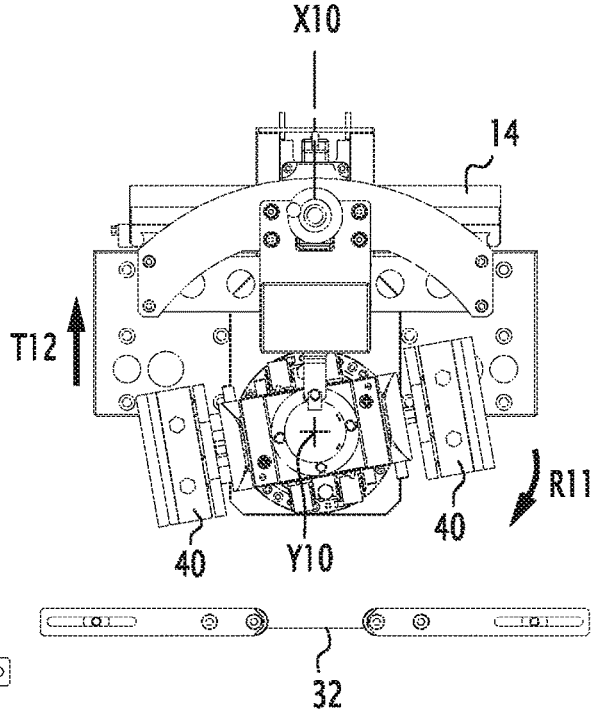

In FIGS. 6 to 9, the marking head 10 comprises a rotary unit 16 centered on the axis Y10, and two arms 18 and two punches 40 which are diametrically opposed with respect to the axis Y10. The elements 16, 18 and 40 have rotational mobility about the axis Y10, preferably in just one direction R11. FIG. 9 shows the retreat of the carriage 14 in the direction T12 and the rotation of the punches 40 between two marking cycles. The punches 40 are used in alternation from one marking cycle to the next. Thus, in the case of hot marking, each of the punches 40 has a longer time available in which to warm back up between two marking cycles. As an alternative, the heating means incorporated into the punches 40 may be supplemented or replaced by heating means which are fixed with respect to the carriage 14 and arranged in the upper part of the marking head 10, for example heating tiles.

Figure 10:
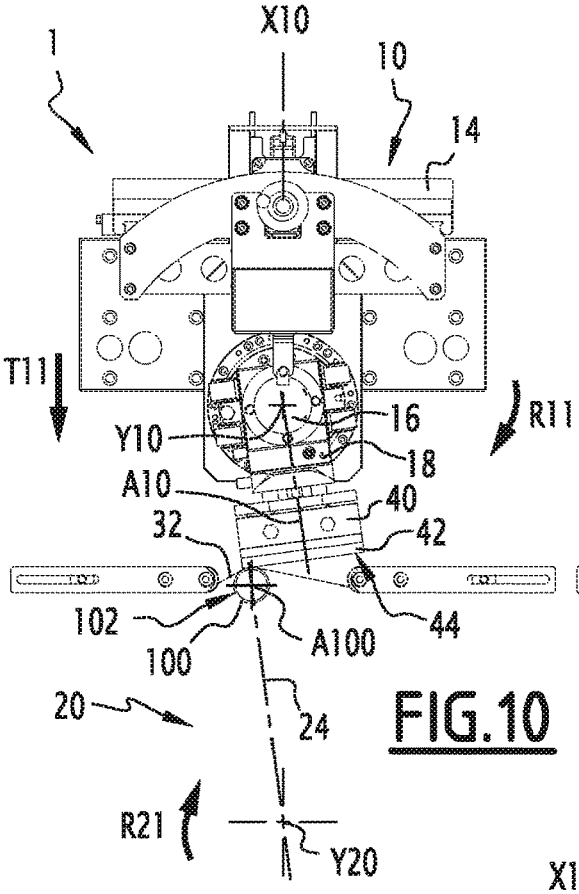
FIGS. 10 to 12 are views analogous to FIGS. 3 to 5, showing a third embodiment of a marking machine according to the invention.
Figure 11:
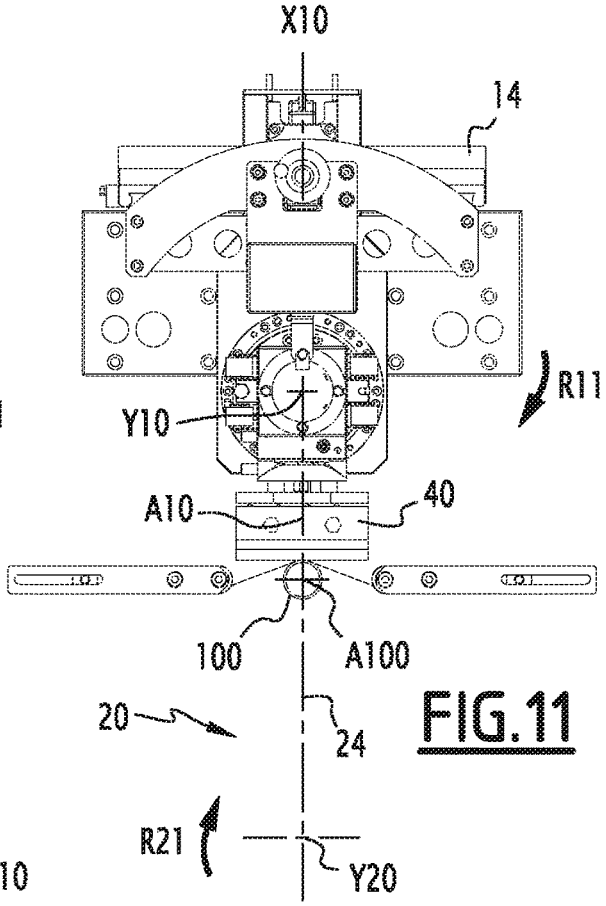
Figure 12:
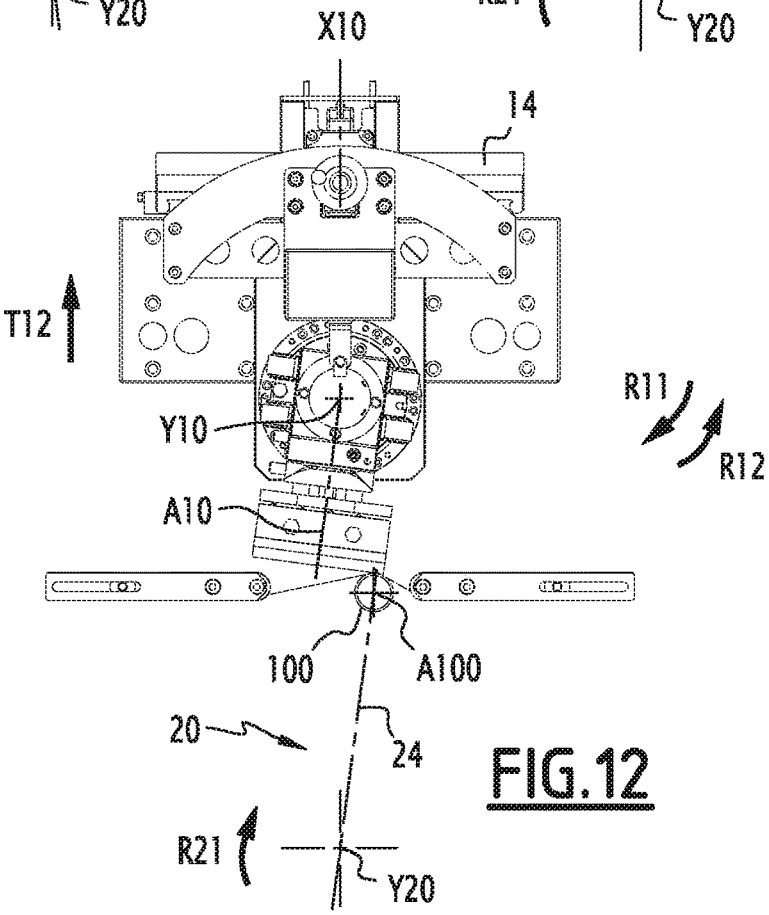

In FIGS. 10 to 12, the marking head 10 comprises a single punch 40 with translational mobility along the axis X10 and rotational mobility about the axis Y10. The punch 40 has rotational mobility either in a one-way movement in the direction R11 or R12, or in an oscillatory movement, namely reciprocating back and forth in the directions R11 and R12. Furthermore, the positioning system 20 comprises arms 24 with rotational mobility about the axis Y20, in a direction of rotation R21, during the marking operation. As a result, the container 100 borne by the arm 24 has rotational mobility about the axis Y20. The translational and rotational movements of the punch 40 are synchronized with the rotational movements of the arm 24 and of the container 100. During the marking operation, in order to create a decorative effect of a given length, the angular amplitude of the movement of the punch 40 about the axis Y10 is divided by two when the container 100 is able to move as in FIGS. 10 to 12, by comparison with a fixed article 100 as in FIGS. 6 to 9.

For preference, during the marking operation, the directions of rotation R11 and R21 are similar, for example both being clockwise directions. In the case where the punch 40 has rotational mobility in a one-way movement in the direction R11, this rotation is synchronized with the rotation R21. In the case where the punch 40 has rotational mobility in an oscillatory movement, the punch 40 is preferably repositioned by moving it in the direction R12 between two marking operations, so that during a marking operation the rotations are synchronized in the directions R11 and R21.

In FIGS. 13 to 16, the marking head 10 comprises two punches 40 with translational mobility along the axis X10 and rotational mobility about the axis Y10. Furthermore, the positioning system 20 comprises arms 24 with rotational mobility about the axis Y20 so that the container 100 has rotational mobility during the marking operation. The translational and rotational movements of the punches 40 are synchronized with the rotational movement of the arm 24 and of the article 100. FIG. 16 shows the retreat of the carriage 14 in the direction T12 and the rotation of the punches 40 between two marking cycles. The embodiment of FIGS. 13 to 16 combines the technical features and advantages of the embodiments of FIGS. 6 to 12.

Figure 17:
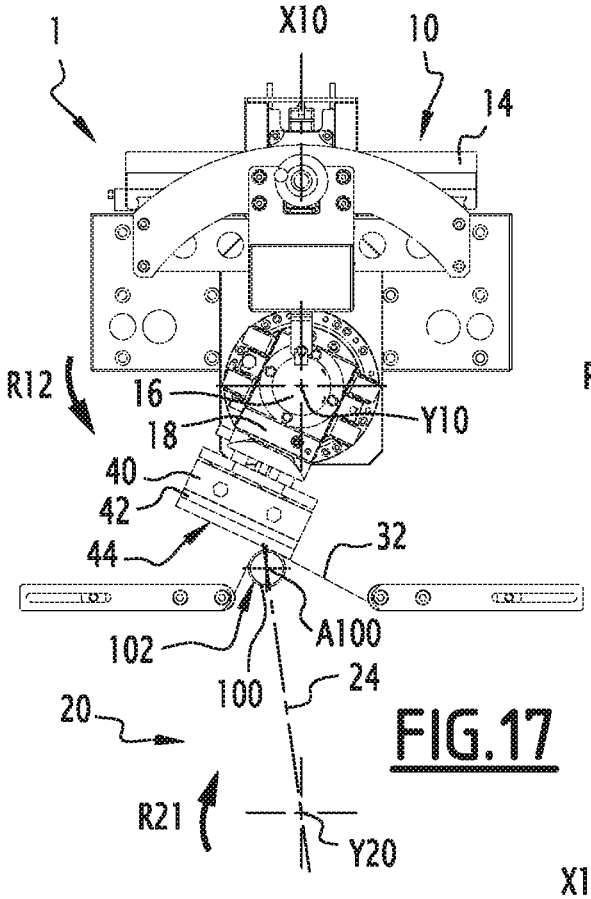
FIGS. 17 to 19 are views analogous to FIGS. 3 to 5, showing a fifth embodiment of a marking machine according to the invention.
Figure 18:
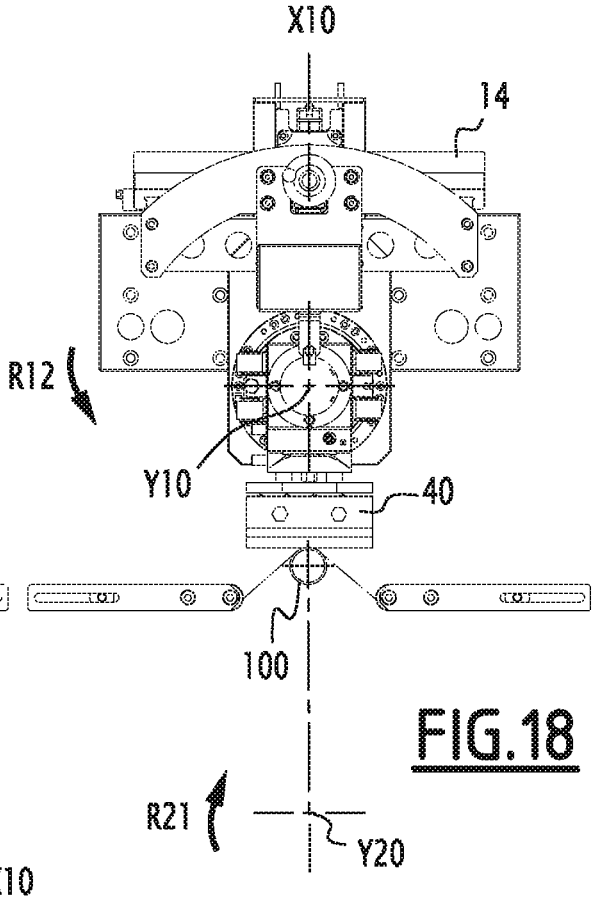
Figure 19:
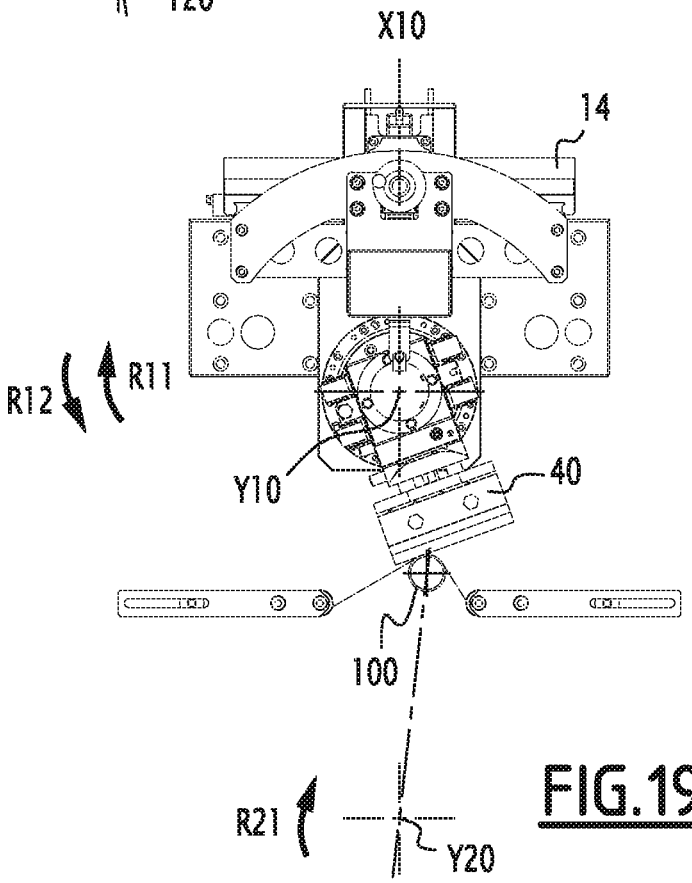
Figure 20:
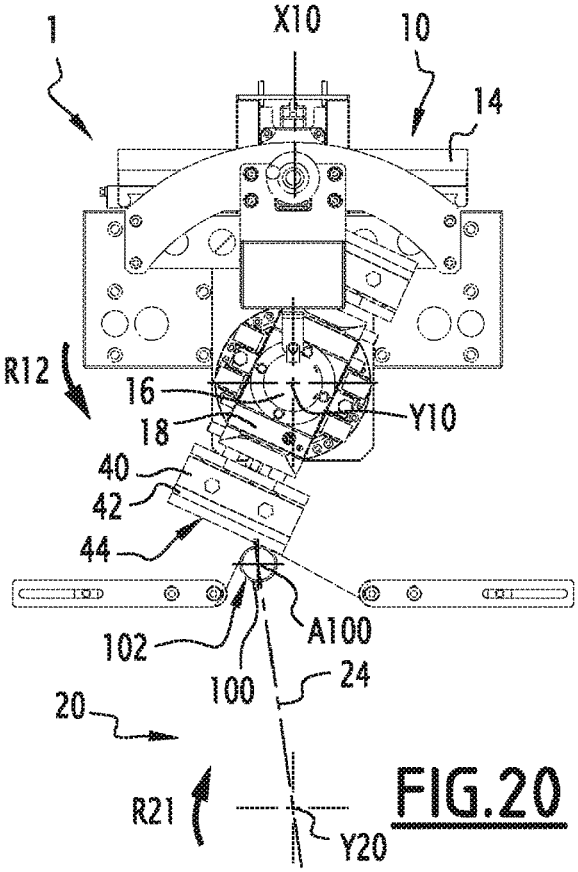
FIGS. 20 to 23 are views analogous to FIGS. 6 to 9, showing a sixth embodiment of a marking machine according to the invention.
Figure 21:
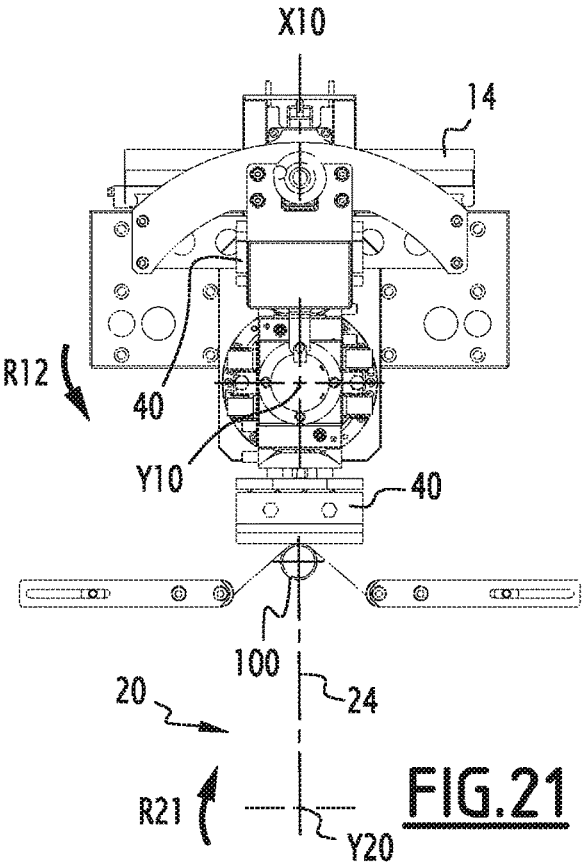
Figure 22:
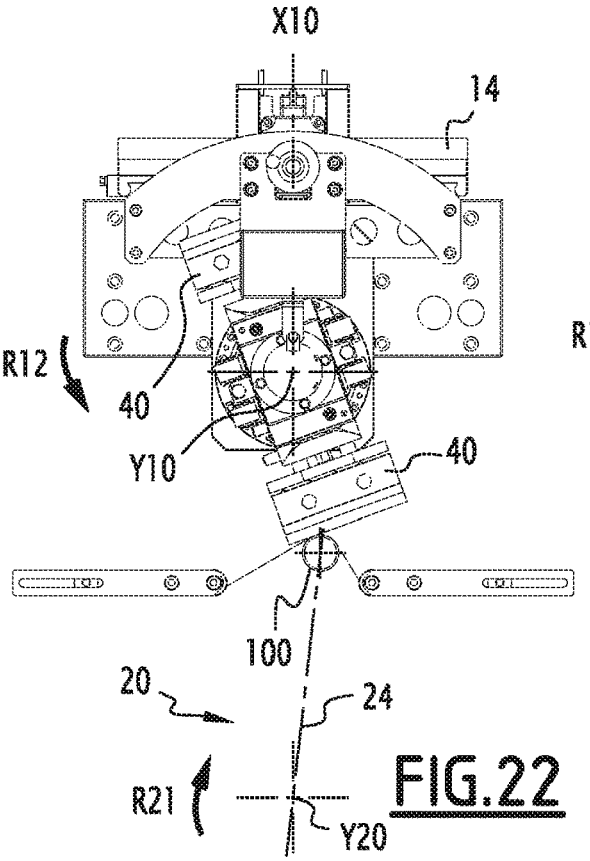

In FIGS. 17 to 19, the elements 14, 16, 18 and 40 have translational mobility along the axis X10, but not during the marking operation. The punch 40 has rotational mobility about the axis Y10, either in a one-way movement in the direction R12 or in an oscillatory movement, which means to say alternating back and forth in the directions R11 and R12. Furthermore, the positioning system 20 comprises arms 24 with rotational mobility about the axis Y20 in the direction of rotation R21 during the marking operation. As a result, the container 100 borne by the arm 24 has rotational mobility about the axis Y20. The rotational movements of the punch 40 are synchronized with the rotational movements of the arm 24 and of the article 100.

For preference, during the marking operation, the directions of rotation R12 and R21 are opposed, for example the punch 40 pivots in the counterclockwise direction R12 whereas the arm 24 pivots in the clockwise direction R21. In the case where the punch 40 has rotational mobility in a one-way movement in the direction R12, this rotation is synchronized with the rotation R21. In the case where the punch 40 has rotational mobility in an oscillatory movement, the punch 40 is preferably repositioned by movement in the direction R11 between two marking operations so that during a marking operation the rotations are synchronized in the directions R12 and R21.

Figure 23:
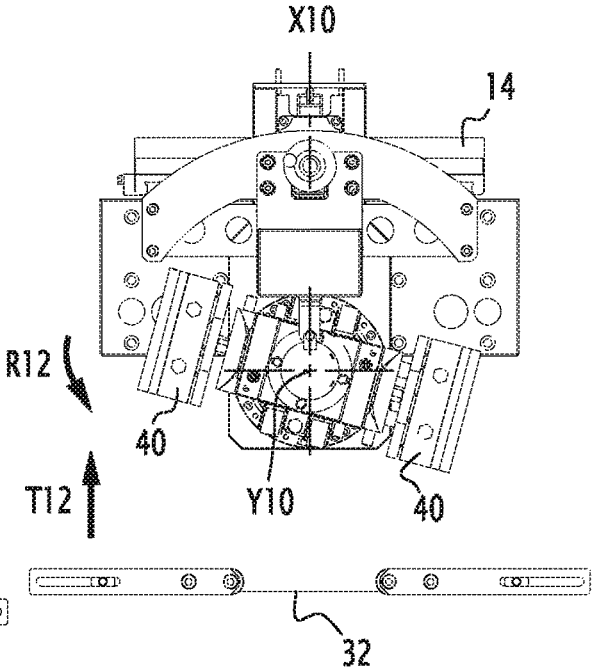
Figure 23:
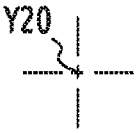

In FIGS. 20 to 23, the elements 14, 16, 18 and 40 have translational mobility along the axis X10 but not during the marking operation. The marking head 10 comprises two punches 40 with rotational mobility about the axis Y10, whereas the positioning system 20 comprises arms 24 with rotational mobility about the axis Y20 during the marking operation. FIG. 23 shows the retraction of the carriage 14 in the direction T12 and the rotation of the punches 40 between two marking cycles. The embodiment of FIGS. 20 to 23 combines the technical features and advantages of the embodiments of FIGS. 6 to 9 and 17 to 19.

Figure 24:
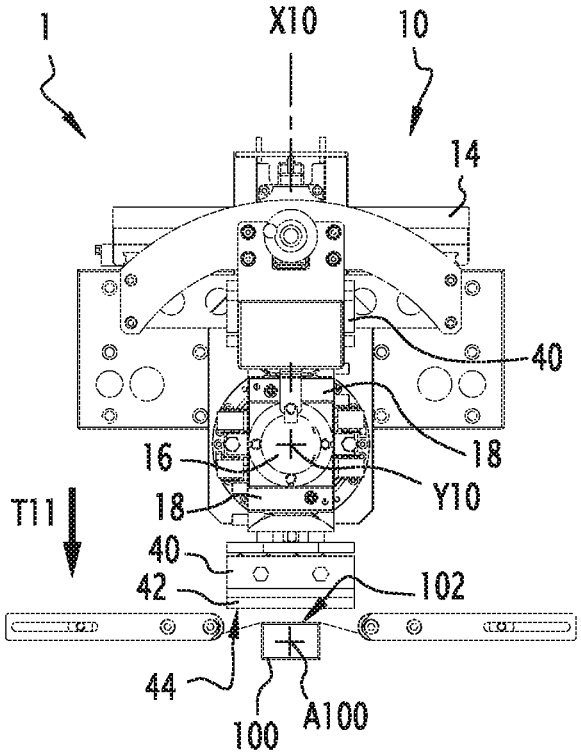
FIGS. 24 to 26 are views analogous to FIGS. 3 to 5, showing a seventh embodiment of a marking machine according to the invention.
Figure 25:
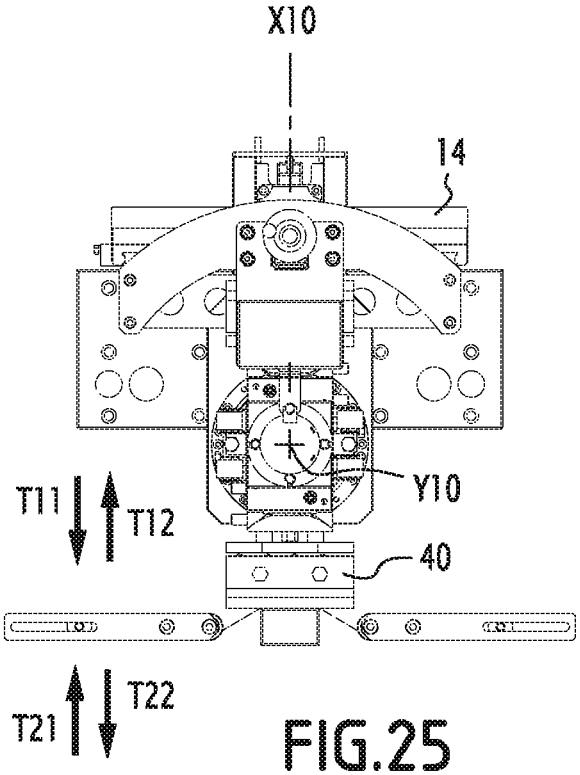
Figure 26:
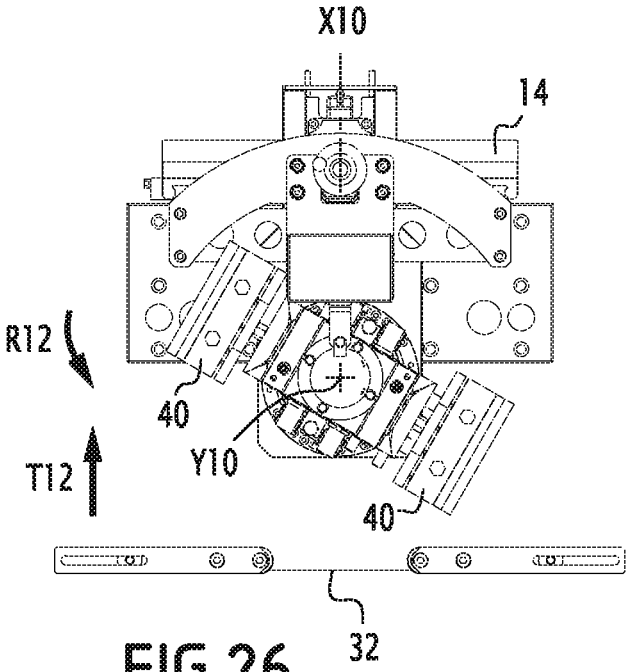
Figure 27:
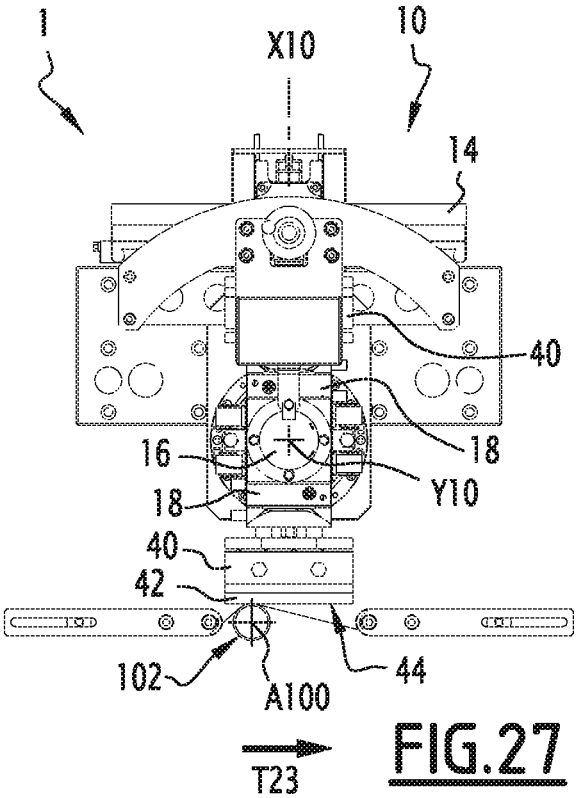
FIGS. 27 to 30 are views analogous to FIGS. 6 to 9, showing an eighth embodiment of a marking machine according to the invention.
Figure 28:
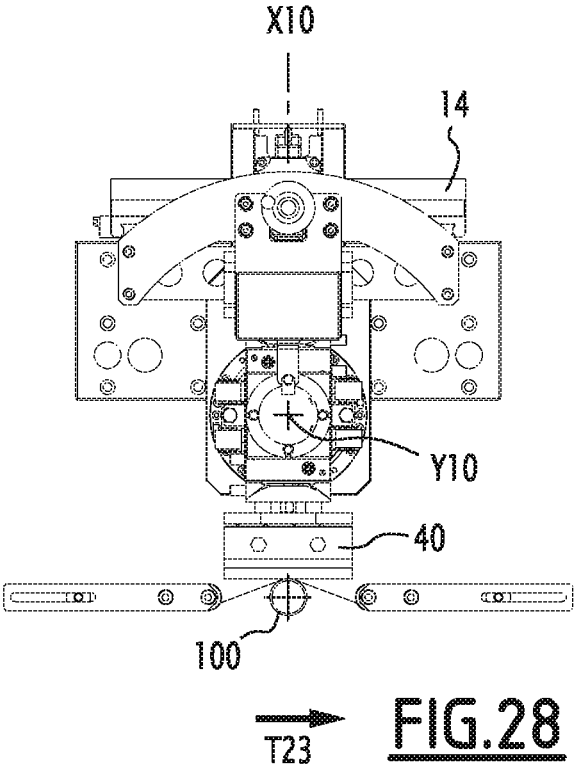
Figure 29:
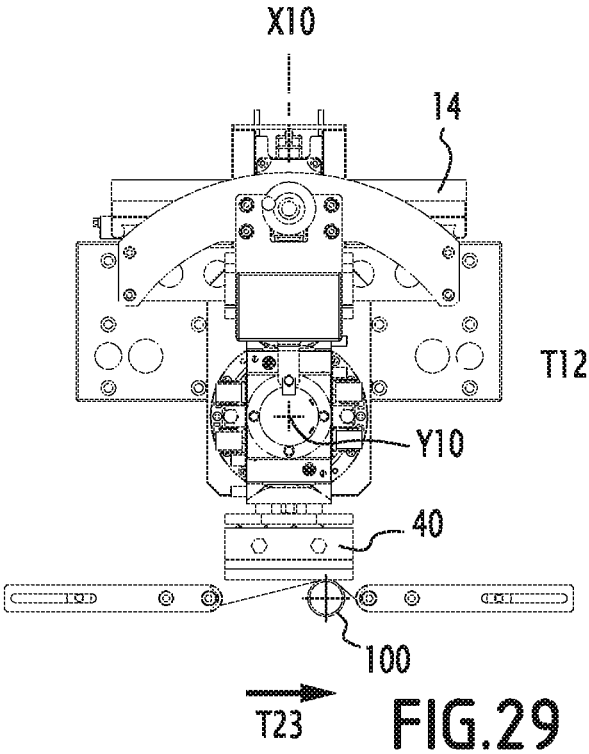

In FIGS. 24 to 26, the marking head 10 is configured to mark a container 100 of parallelepipedal shape, rather than of cylindrical or conical tubular shape, by striking it. As an alternative, the marking head 10 may mark a faceted tubular container 100 with a polygonal cross section, or any other type of container 100 comprising at least one planar face. In the case of marking by striking, the punch or punches 40 have rotational mobility before and after the marking operation but not during the marking operation. During the operation of marking by striking which is shown in FIG. 25, the punch 40 has translational mobility along the axis X10 to mark the container 100, in the direction T11 and then in the direction T12, without pivoting about the axis Y10. A pressing time is provided during which time the surface 44 of the punch 40 is held firmly against the surface 102 of the container 100. FIG. 26 shows the retraction of the carriage 14 in the direction T12 and the rotation of the punches 40 between two marking cycles.

As an alternative, marking by striking can be achieved using a punch 40 which remains fixed, while the positioning system 20 is configured to move the container 100 translationally along the axis X10, in a direction T21 heading toward the punch 40 then in a direction T22 that is the opposite of the direction T21.

Figure 30:
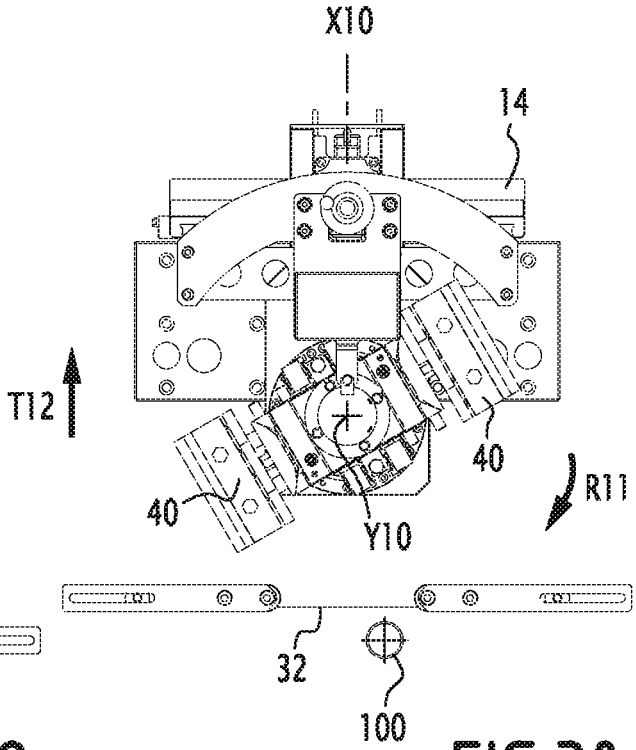

In FIGS. 27 to 30, the elements 14, 16, 18 and 40 have translational mobility along the axis X10 but not during the marking operation. The marking head 10 comprises two punches 40 with rotational mobility about the axis Y10. The positioning system 20 is configured to move the container 100 transversely, namely in a direction of translational movement T23 perpendicular to the axis X10, so that the surface 102 of the container 100 rolls against the surface 44 of the punch 40 kept fixed during the marking operation. FIG. 30 shows the retraction of the carriage 14 in the direction T12 and the rotation of the punches 40 between two marking cycles.

Furthermore, the marking machine 1 may be configured differently from FIGS. 1 to 30 without departing from the scope of the invention. In particular, the marking head 10, the positioning system 20 and the distribution system 30 may be configured differently. Furthermore, the machine 1 may mark articles 100 of different types, forms and materials.

By way of an alternative that has not been depicted, the axis X10 may be arranged horizontally while the axes Y10 and Y20 may be arranged vertically.

According to another alternative form that has not been depicted, the axis X10 of the marking head 10 and the axis Y20 of the positioning system 20 are both arranged vertically. For example, the positioning system 20 may be configured as a horizontal disk on which the axis A100 of the container 100 is oriented horizontally.

According to another alternative form that has not been depicted, the machine 1 may comprise a linear transport and positioning system, rather than the pivoting transport and positioning system 20 depicted in FIGS. 1 to 30.

Whatever the embodiment, the marking machine 1 comprises a marking head 10 that includes a support 14 and at least one punch 40 equipped with a flat pattern plate 42; and a positioning system 20 configured to position an article 100 with respect to the punch 40. The punch 40 has rotational mobility about an axis of rotation Y10 that is fixed with respect to the support 14. For preference, the support 14 is a carriage with translational mobility along an axis of marking X10 perpendicular to the axis of rotation Y10.

Furthermore, the technical features of the various embodiments and alternative forms mentioned hereinabove may, in their entirety or in respect of just some, be combined with one another. Thus, the marking machine 1 can be adapted in terms of cost and of performance.

The invention claimed is:

1. A marking machine for marking an article, the machine comprising:

a marking head including a support and at least one punch; and a positioning system configured to position the article with respect to the at least one punch;

wherein the at least one punch is rotatable about an axis of rotation that is fixed with respect to the support, the at least one punch moving relative to the support when rotating about the axis of rotation, wherein the marking head includes an arm that is rotatable about the axis of rotation, the arm supporting the at least one punch and moving relative to the support when rotating about the axis of rotation, wherein the support is a carriage configured to translate along a marking axis perpendicular to the axis of rotation such that the at least one punch translates along the marking axis.

2. The marking machine as claimed in claim 1, wherein, during a marking operation, the at least one punch is configured to translate along the marking axis and strike the article without pivoting about the axis of rotation.

3. The marking machine as claimed in claim 1, wherein, during a marking operation, the at least one punch is configured to move along the marking axis and rotate about the axis of rotation to progressively mark the article.

4. The marking machine as claimed in claim 1, wherein the at least one punch is rotatable about the axis of rotation in an oscillatory movement.

5. The marking machine as claimed in claim 1, wherein the at least one punch is rotatable about the axis of rotation in a one-way movement.

6. The marking machine as claimed in claim 1, wherein the axis of rotation is a first axis of rotation and the positioning system comprises at least an arm for supporting the article the arm being rotatable about a second axis of rotation.

7. The marking machine as claimed in claim 1, wherein the positioning system comprises at least an arm for supporting the article with translational mobility with respect to the marking head.

8. The marking machine as claimed in claim 1, wherein the at least one punch is configured to repeatedly circle the axis of rotation.

9. The marking machine as claimed in claim 1, wherein a path of the at least one punch has a uniform radius of curvature about the axis of rotation.

10. The marking machine as claimed in claim 1, wherein the axis of rotation moves relatively toward and away from the article as the at least one punch rotates about the axis of rotation.

11. The marking machine as claimed in claim 10, wherein the axis of rotation is a first axis of rotation, the positioning system configured to rotate the article about a second axis of rotation.

12. The marking machine as claimed in claim 1, wherein the at least one punch includes a flat pattern plate.

13. A method for operating a marking machine as claimed in claim 1, wherein the at least one punch has rotational mobility about the axis of rotation during at least part of a marking cycle including a marking operation.

14. The method as claimed in claim 13, wherein the at least one punch also has translational mobility along a marking axis perpendicular to the axis of rotation during at least part of the marking cycle.

15. The method as claimed in claim 14, wherein, during the marking cycle:

before the marking operation, the at least one punch has rotational mobility about the axis of rotation;

during the marking operation, the at least one punch has translational mobility along the marking axis without pivoting about the axis of rotation, thus marking the article by striking the article; and after the marking operation, the at least one punch has rotational mobility about the axis of rotation.

16. The method as claimed in claim 14, wherein, during the marking operation, the at least one punch has translational mobility along the marking axis and rotational mobility about the axis of rotation, thus progressively marking the article.

17. The method as claimed in claim 13, wherein the at least one punch has rotational mobility about the axis of rotation in an oscillatory movement.

18. The method as claimed in claim 13, wherein the at least one punch has rotational mobility about the axis of rotation in a one-way movement.

19. The method as claimed in claim 13, wherein, during the marking cycle, a support arm supporting the article and belonging to the positioning system has rotational mobility about a second axis of rotation parallel to the axis of rotation of the at least one punch.

* * * * *